US012654059B2

(12) United States Patent
Hoang

(10) Patent No.: US 12,654,059 B2
(45) Date of Patent: Jun. 16, 2026

(54) ADJUSTABLE FOOT PLATE FOR ROWING MACHINES

(71) Applicant: Aviron Interactive Inc., North York (CA)

(72) Inventor: Andy Hoang, Toronto (CA)

(73) Assignee: Aviron Interactive Inc., North York (CA)

( * ) Notice: Subject to any disclaimer, the term of this patent is extended or adjusted under 35 U.S.C. 154(b) by 317 days.

(21) Appl. No.: 18/465,311

(22) Filed: Sep. 12, 2023

(65) Prior Publication Data

US 2024/0082627 A1 Mar. 14, 2024
US 2025/0170446 A9 May 29, 2025

Related U.S. Application Data

(60) Provisional application No. 63/406,113, filed on Sep. 13, 2022.

(51) Int. Cl.
*A63B 21/00* (2006.01)
*A63B 22/00* (2006.01)

(52) U.S. Cl.
CPC ..... *A63B 21/4034* (2015.10); *A63B 22/0076* (2013.01); *A63B 2225/09* (2013.01)

(58) Field of Classification Search
CPC ..... A63B 21/4034; A63B 22/0076; A63B 2225/09; A63B 21/4015; A63B 2022/0079; A63B 22/0087; A63B 21/4001; A63B 22/0046; A63B 21/4033; A63B 23/03525
See application file for complete search history.

(56) References Cited

U.S. PATENT DOCUMENTS

| | | | | |
|---|---|---|---|---|
| 5,707,322 | A * | 1/1998 | Dreissigacker .... | A63B 21/4015 482/908 |
| 6,231,485 | B1 * | 5/2001 | Dreissigacker .... | A63B 22/0076 482/57 |
| 9,901,772 | B2 * | 2/2018 | Crowley ..... | A63B 22/0087 |
| 11,103,740 | B2 | 8/2021 | Boyles et al. | |
| 2015/0297943 | A1 * | 10/2015 | Yeh ..... | A63B 22/0076 74/594.7 |
| 2020/0282256 | A1 * | 9/2020 | Boyles ..... | A63B 22/0046 |
| 2024/0342547 | A1 * | 10/2024 | Petrillo ..... | A63B 71/0622 |

FOREIGN PATENT DOCUMENTS

| | | |
|---|---|---|
| CN | 206434773 U | 8/2017 |
| CN | 209237253 U | 8/2019 |

* cited by examiner

*Primary Examiner* — Loan B Jimenez
*Assistant Examiner* — Catrina A Letterman
(74) *Attorney, Agent, or Firm* — Own Innovation; Sanjeevan Shivakumar; James W. Hinton

(57) ABSTRACT

An adjustable foot plate for rowing machines is provided. The foot plate includes two platforms for placing a user's feet thereon when using the rowing machine. Each platform includes a strap, a heel counter and lengthening member for adjusting a distance between the strap and the heel counter to align the widest part of the user's foot with the strap. The platforms are laterally adjustable by a linear drive mechanism to vary a distance between the user's feet to better accommodate users of varying size/height. Lateral adjustment of the platforms may also provide for the user to exercise different muscle groups as part of an exercise regime.

17 Claims, 9 Drawing Sheets

ADJUSTABLE FOOT PLATE FOR ROWING MACHINES

TECHNICAL FIELD

The embodiments disclosed herein relate to equipment for rowing machines, and, in particular to a laterally adjustable foot plate.

INTRODUCTION

Rowing machines include a foot plate for the user to place their feet on when using the machine. The foot plate is typically fixed to a frame of the rowing machine at a position forward of a seat. Some rowing machines have a foot plate that is a single platform spanning a seat rail of the rowing machine. Other rowing machines have two separate platforms (each platform for placing one foot of the user thereon) straddling the seat rail of the rowing machine.

Foot plates often includes straps and heel counters for securing the user's foot to the foot plate. The foot plate is inclined to allow the user to brace themselves, during the drive phase of a rowing stroke, and for leverage during the recovery phase of a rowing stroke. Generally, it is preferred for the user to keep their feet close together to generate maximum power and range of motion. However, for some users, keeping their feet together while rowing for long durations is uncomfortable.

Some rowing machines have a foot plate that is adjustable to accommodate different size feet/shoes. Such foot plates can be lengthened or shortened, to better fit the foot plate to the user's foot/shoe, (see for example, U.S. patent Ser. No. 11/103,740 and China Patent No. 206434773).

Lateral adjustment (i.e., widening) of the foot plate, typically is not possible given that the foot plate is fixed to the frame of the rowing machine. In addition, the straps for securing the user's foot to the foot plate are themselves fixed at one position on the foot plate. This may make it difficult or uncomfortable for certain users to use the rowing machine since, their feet when secured to the foot plate, may be spaced too close together, or spaced too far apart, depending on the size/weight, hip width and hip flexibility of the user.

Accordingly, there is a need for a foot plate for rowing machines which can be adjusted laterally to better accommodate users of varying size/height, hip width and hip flexibility.

SUMMARY

According an embodiment, there is an adjustable foot plate for a rowing machine. The foot plate includes a plurality of mounting points for attaching the foot plate to the rowing machine and a pair of parallel guide rails. A left foot platform and a right foot platform are mounted on the guide rails.

Each foot platform includes a strap for securing a user's foot to the foot platform, a locking member and a lengthening member. The lengthening member includes a heel counter and a front end, the front end passing under the strap and through the locking member. The front end is moveable through the locking member to vary a distance between the heel counter and the strap. The locking member fixedly holds the front end to fix a distance between the strap and the heel counter.

The adjustable foot plate further includes a linear drive mechanism for moving the foot platforms laterally along the guide rails to vary a distance between the foot platforms. The linear drive mechanism includes a first-handed fixed nut on the left foot platform, a second-handed fixed nut on the right foot platform and a screw shaft having a first-handed segment passing through the first-handed fixed nut and a second-handed threaded segment passing through the second-handed fixed nut. A crank is connected to the screw shaft.

When the crank is turned, the fixed nuts on each platform move in opposite directions along the screw shaft, thereby causing the platforms to travel laterally in opposite directions along the guide rails. According to some embodiments, the screw shaft is connected to a motor or an actuator for rotating the screw shaft.

The foot plate further includes a support member disposed on the frame between the platforms at an equidistant point between the fixed nuts for holding the screw shaft in parallel with the guide rails.

According to another embodiment, there is a rowing machine comprising an adjustable foot plate. The foot plate is mounted to a frame of the rowing machine and straddles a seat rail of the rowing machine.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below.

Figure 1A:
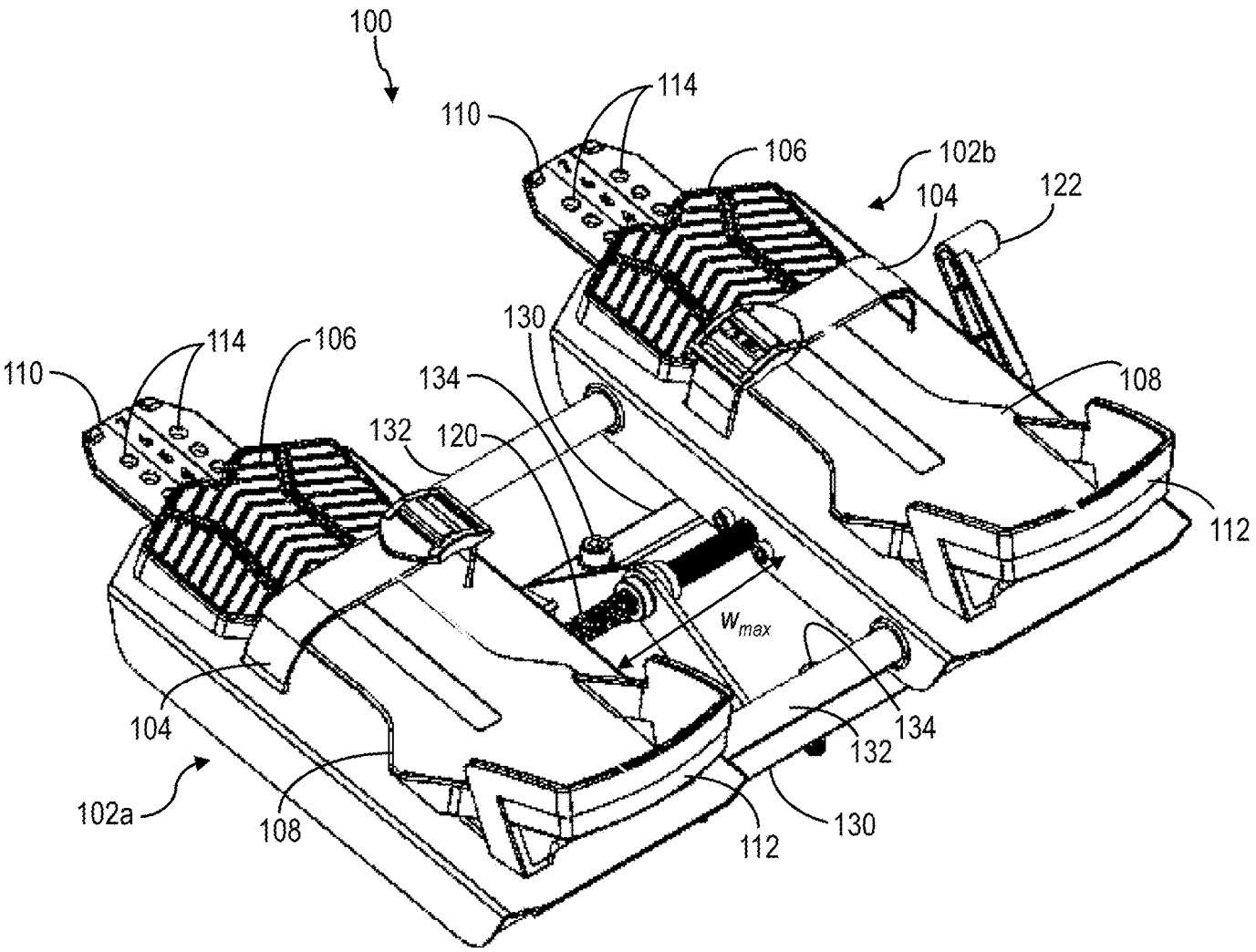
FIG. 1A is a perspective view of an adjustable foot plate, shown in a wide configuration, according to an embodiment.
Figure 2A:
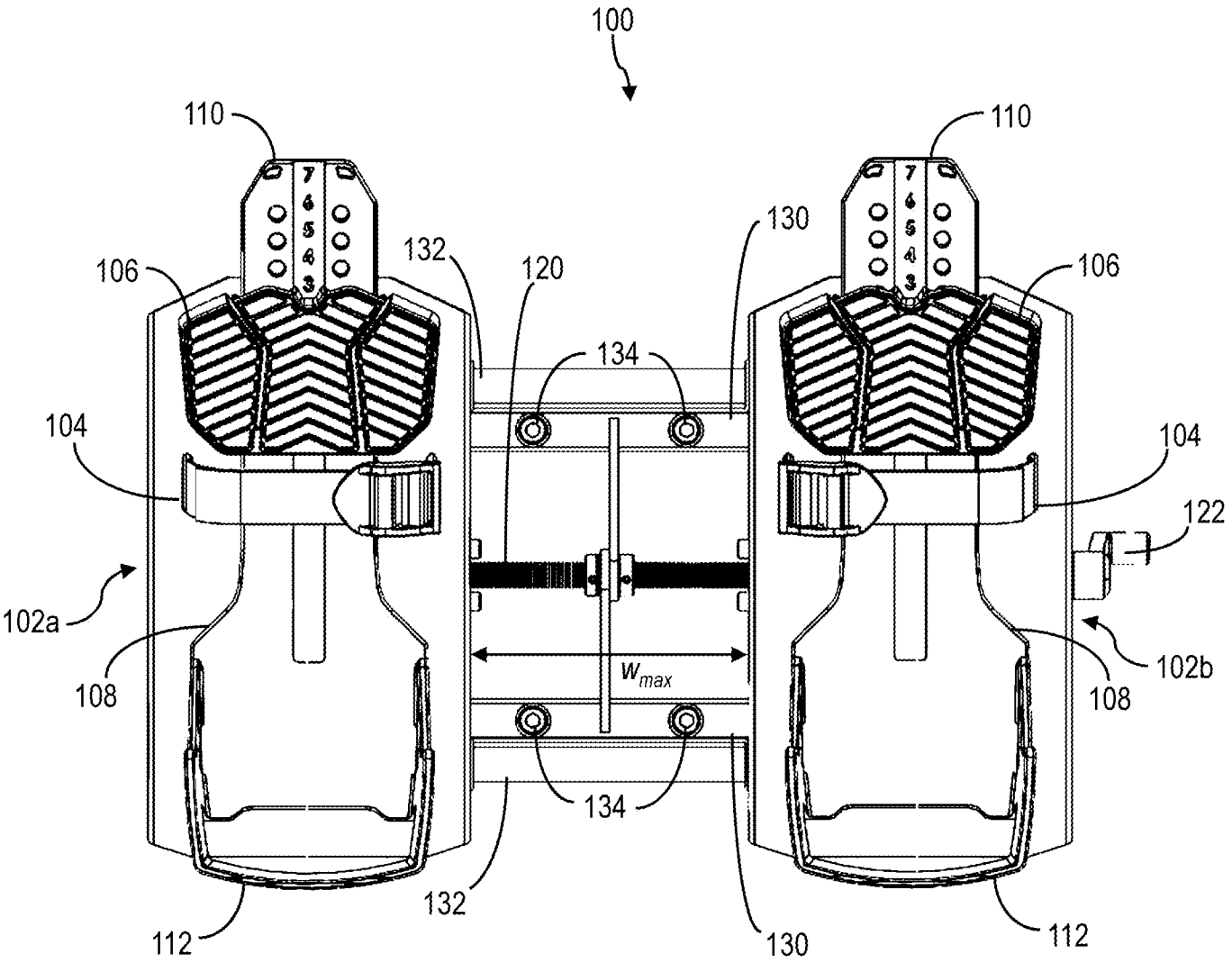
FIGS. 2A and 2B are top views of the adjustable foot plate shown in FIGS. 1A and 1B, respectively.

Referring to FIGS. 1A and 2A shown therein is an adjustable foot plate 100, shown in a wide configuration, according to an embodiment. The foot plate 100 includes a pair of platforms 102*a*, 102*b*; a left platform 102*a* for placing a user's left foot thereon, and a right platform 102*b* for placing the user's right foot thereon. Each platform 102*a*, 102*b* includes at least one strap 104 for securing the user's respective foot to the platform.

Each platform 102*a*, 102*b* includes a lengthening member 108 having a front end 110 and a heel counter 112. When the user's foot is placed on the platform 102*a*, 102*b*, the user's heel is cradled by the heel counter 112 and the strap 104 is passed over/around the widest part of the user's foot, typically the region of the metatarsophalangeal joints (toe knuckles). To align the widest part of the user's foot with the strap 104, the front end 110 of the lengthening member 108 is passed under the strap 104 and through a locking member 106, to lengthen or shorten a distance, d, between the heel counter 112 and the strap 104.

The locking member 106 includes locking lugs 107 to engage corresponding apertures 114 in the front end 110 of the lengthening member 108 to lock the lengthening member 108 in place. The apertures 114 may be numbered according to shoe sizes to aid in adjusting the lengthening member 108 to the appropriate position prior to locking in place.

Preferably, the locking member 106 is biased to allow travel of the lengthening member 108, to shorten d, and prevent travel of the lengthening member 108 to lengthen d, unless the bias is overcome by the user. For example, to overcome the bias, the user pulls/lifts a tab on the locking member 106 to disengage the locking lugs 107 from the apertures 114 to allow the lengthening member 108 to travel freely through the locking member 106 to lengthen, or shorten d.

According to other embodiments, the locking member 106 may include a spring-biased ratcheting mechanism, or other locking mechanism to lock the lengthening member 108 in place.

Figure 1B:
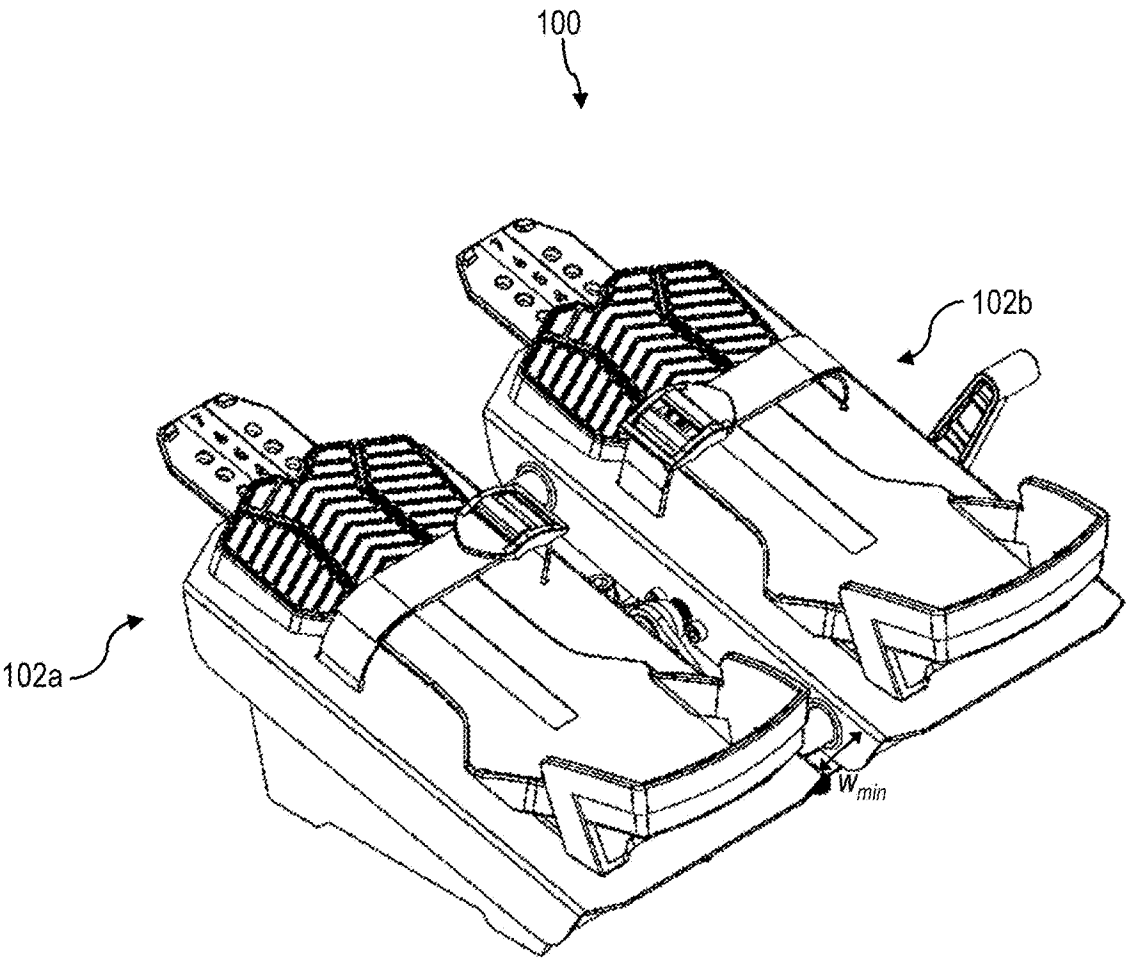
FIG. 1B is a perspective view of the adjustable foot plate shown in FIG. 1A, shown in a narrow configuration.
Figure 2B:
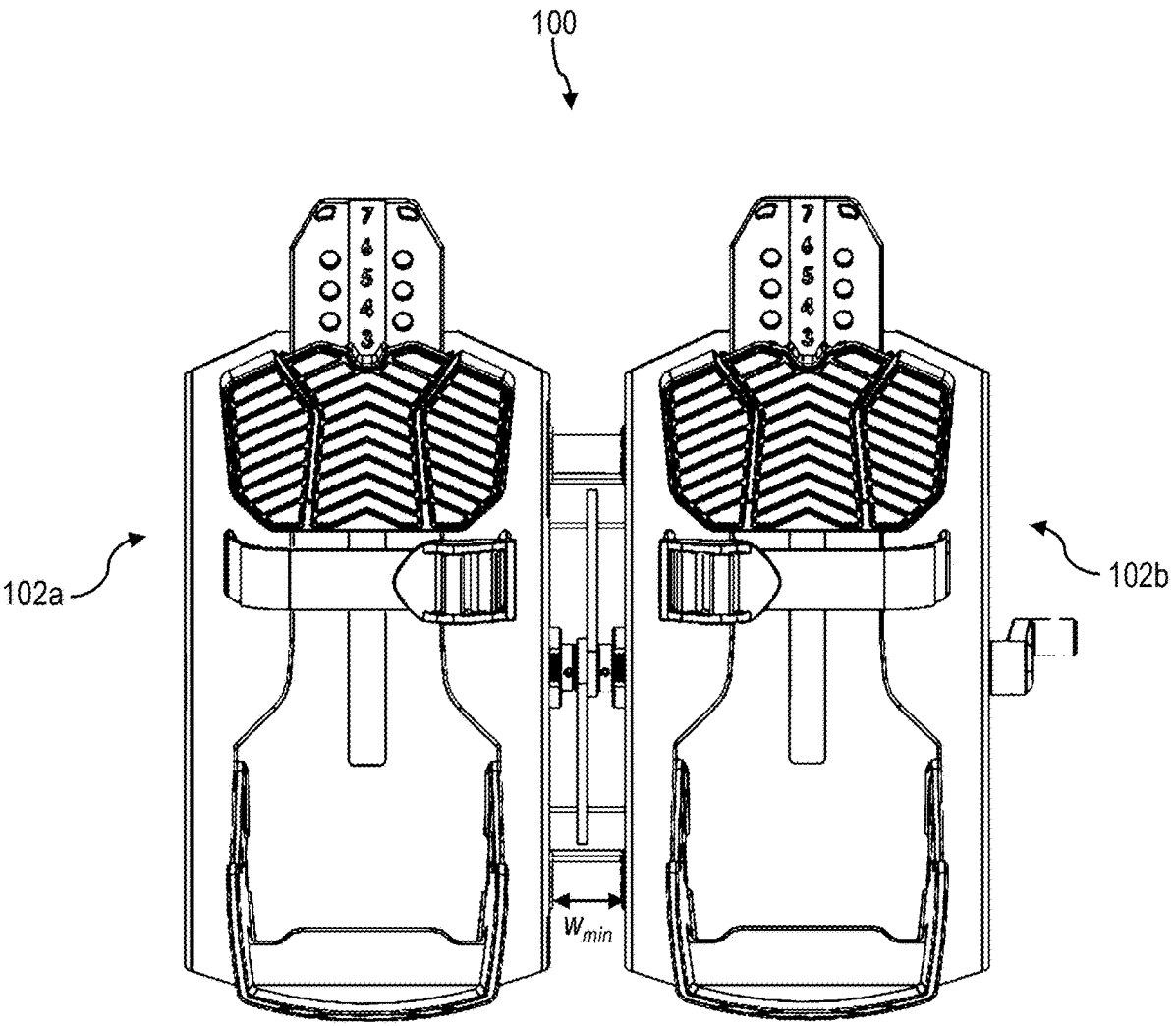
Figure 3A:
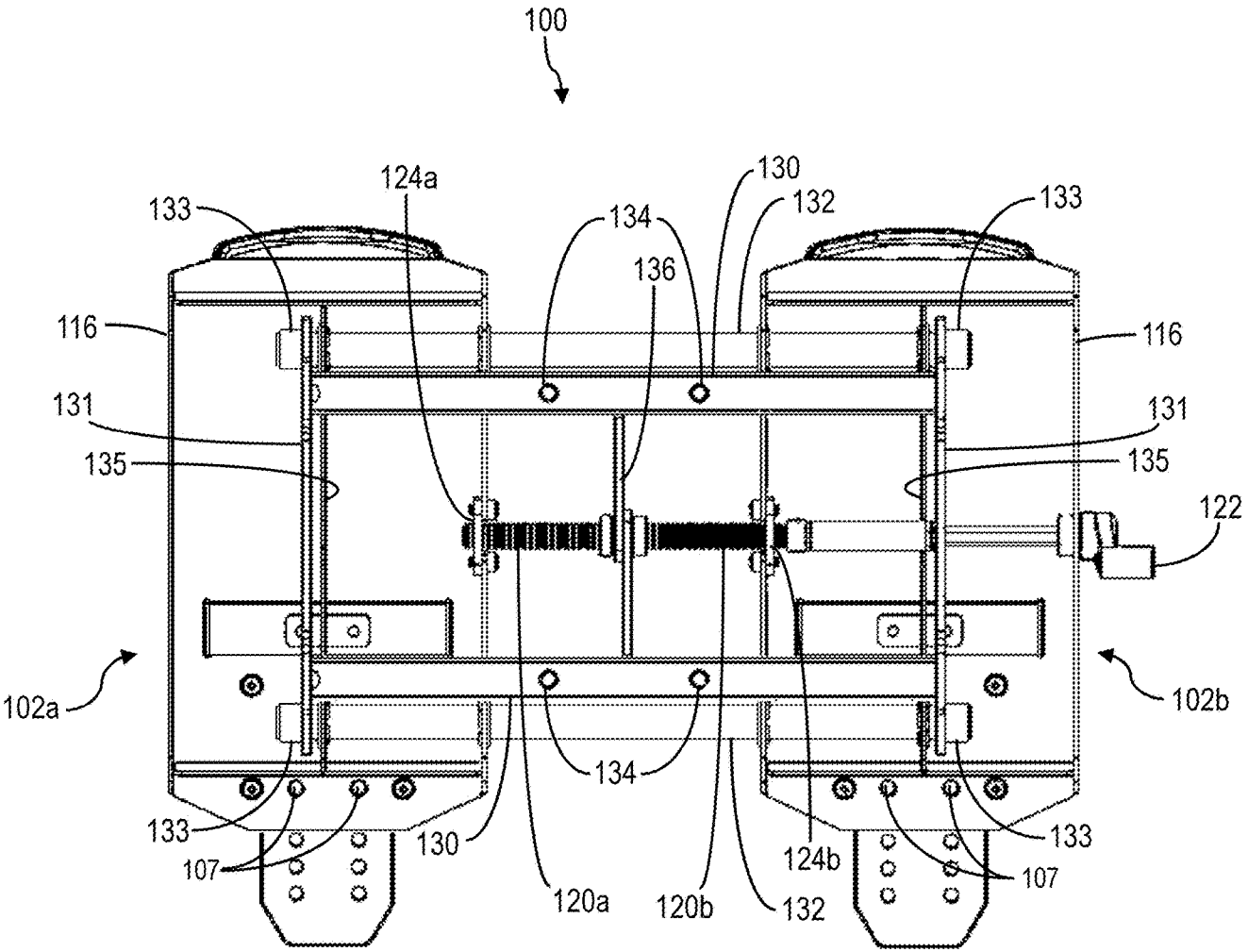
FIGS. 3A and 3B are bottom views of the adjustable foot plate shown in FIGS. 1A and 1B, respectively.
Figure 3B:
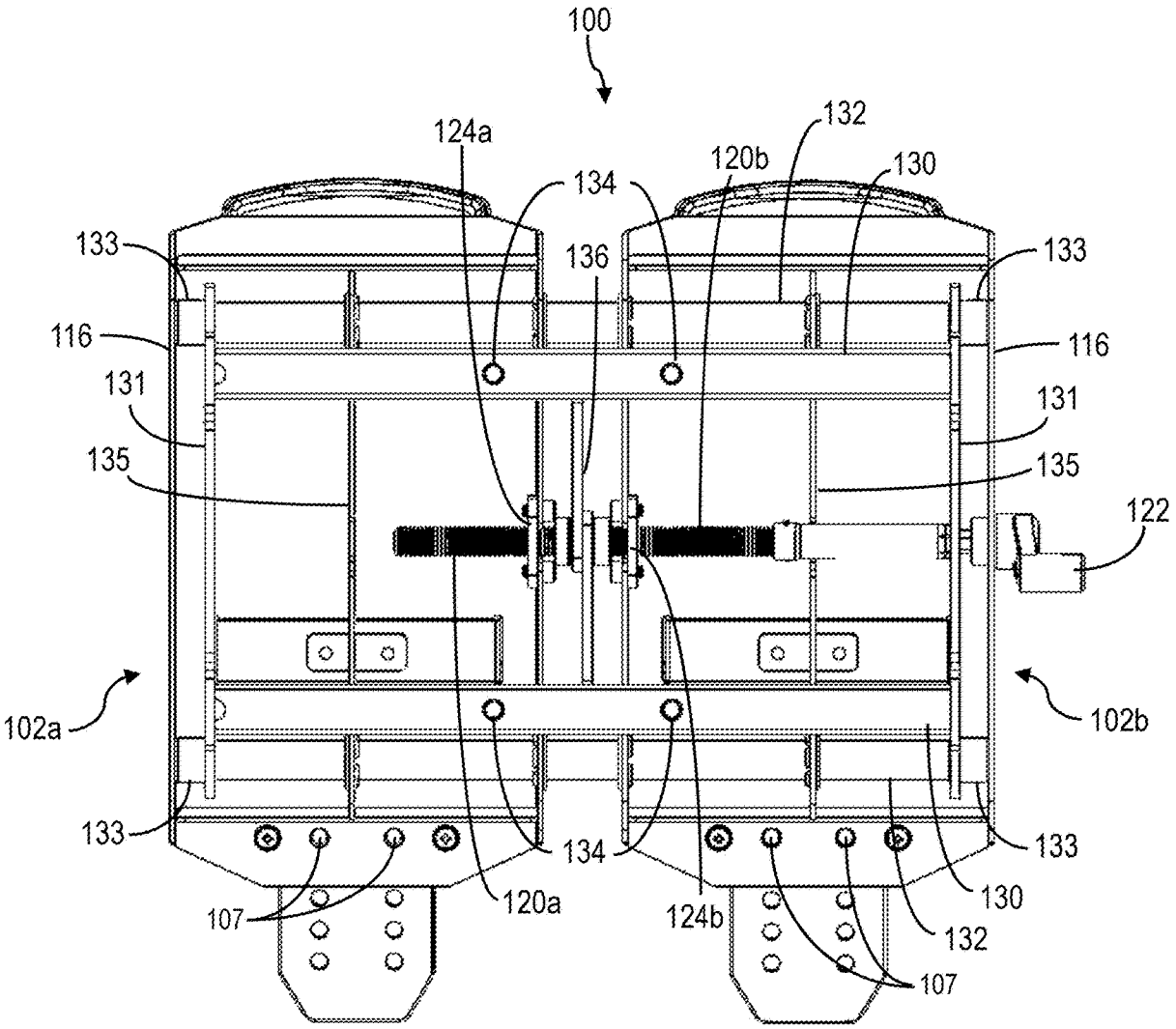
Figure 4A:
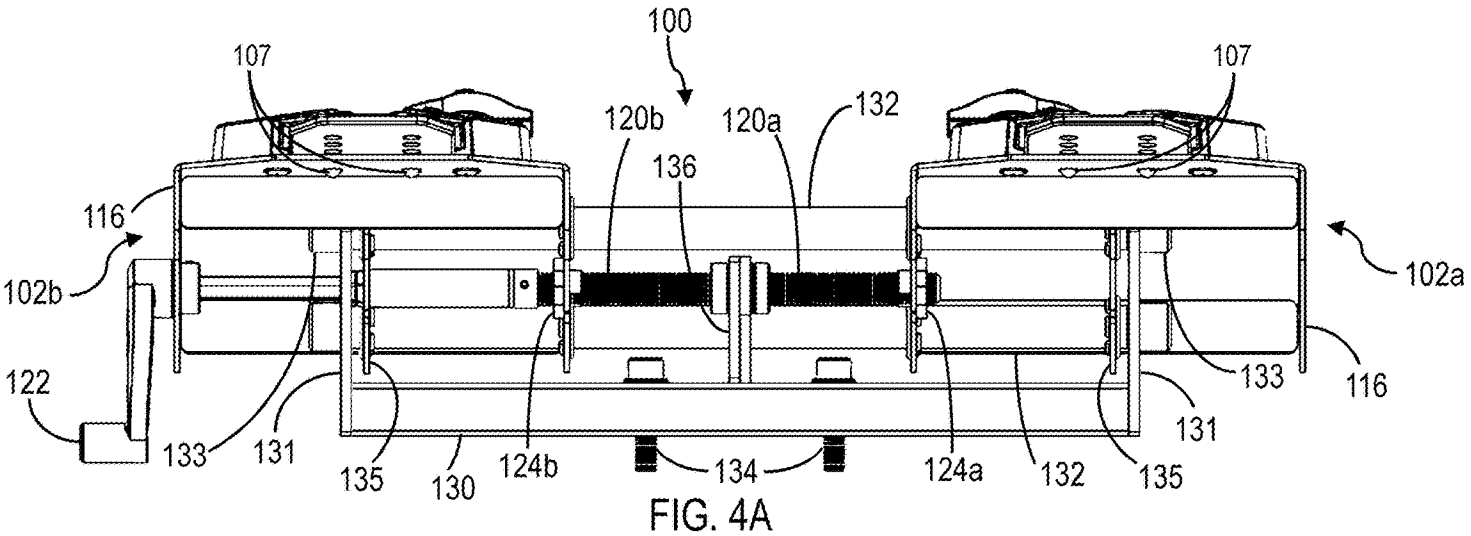
FIGS. 4A and 4B are front views of the adjustable foot plate shown in FIGS. 1A and 1B, respectively.
Figure 4B:
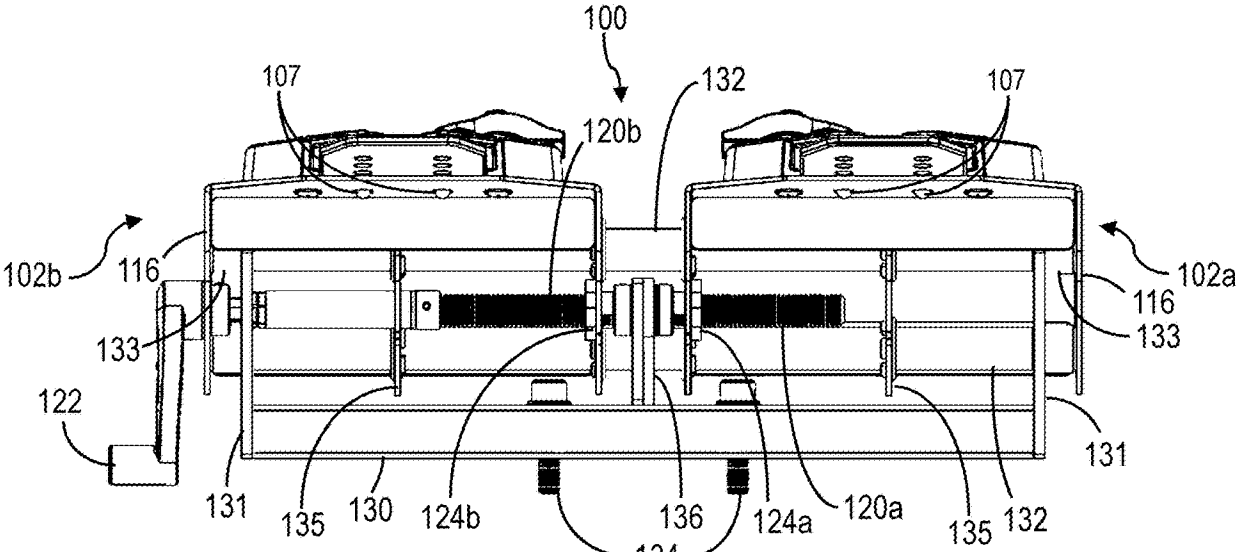

The foot plate 100 includes a frame 130 for supporting the platforms 102*a*, 102*b*. The frame 130 further provides for the platforms 102*a*, 102*b* to be adjusted laterally to vary a distance, w, between the platforms 102*a*, 102*b*. Generally, the distance w, is less than or equal to a maximum distance, $W_{max}$, corresponding to the wide configuration (FIGS. 1A and 2A), and greater than or equal to a minimum distance, $W_{min}$, corresponding to the narrow configuration (FIGS. 1B and 2B).

The frame 130 includes a pair of parallel guide rails 132 on which the platforms 102*a*, 102*b* are mounted. Lateral movement of the platforms 102*a*, 102*b* along the guide rails 132, is driven by a crank 122 connected to a screw shaft 120 of a linear drive mechanism that converts the rotational motion of the crank 122 into linear motion of the platforms 102*a*, 102*b* as described below. The screw shaft 120 and the guide rails 132 may substantially lie in a plane.

According to various embodiments, the linear drive mechanism may be a screw-and-nut drive, a leadscrew, a ball screw, or the like. Referring to FIGS. 3A, 3B, 4A and 4B, each platform 102*a*, 102*b* includes a fixed nut 124*a*, 124*b*. The fixed nuts 124*a*, 124*b* may be fixed nut plates, T-nuts, leadscrew nuts or balls crew nuts. The fixed nuts 124*a*, 124*b* are threaded to receive the screw shaft 120, thereby forming the linear drive mechanism for moving the platforms 102*a*, 102*b* laterally.

The screw shaft 120 includes a first threaded segment 120*a* and a second threaded segment 120*b*. The threaded segments 120*a*, 120*b* have threading with opposite handedness. For example, the first threaded segment 120*a* includes right-handed threads running clockwise and the second threaded segment 120*b* includes left-handed threads running counterclockwise. The fixed nuts 124*a*, 124*b* are similarly threaded to have opposite handedness to engage the respective threaded segments 120*a*, 120*b*. For example, a first fixed nut 124*a* includes a right-handed thread to engage the right-handed thread of the first threaded segment 120*a*, and a second fixed nut 124*b* includes a left-handed thread to engage the left-handed thread of the second threaded segment 120*b*.

According to some embodiments, a support member 136 is disposed on the frame 130 between the platforms 102*a*, 120*b* at an equidistant point between the fixed nuts 124*a*, 124*b* for holding the screw shaft 120 in parallel with the guide rails 132. The fixed nuts 124*a*, 124*b* align with a collar in the support member 136. The screw shaft 120 is passed through the fixed nuts 124*a*, 124*b* and the collar in the support member 136 therebetween.

When the crank 122 is turned in a first direction (e.g., clockwise) the screw shaft 120 is wound through the fixed nuts 124*a*, 124*b* causing the fixed nuts 124*a*, 124*b* to travel in opposite directions along the screw shaft 120, thereby causing the platforms 102*a*, 102*b* to move laterally in opposite directions along the guide rails 132 toward one another, decreasing the distance between the platforms 102*a*, 102*b*. When the crank 122 is rotated in the opposite direction (e.g., counterclockwise) the screw shaft 120 is wound through the fixed nuts 124*a*, 124*b*, causing the fixed nuts to travel in opposite directions along the screw shaft 120, thereby causing the platforms 102*a*, 102*b* to separate laterally along the guide rails 132 increasing the distance between the platforms 102*a*, 102*b*. The screw shaft 120, the fixed nuts 124*a*, 124*b* and the guide rails 132 should be sufficiently lubricated to allow smooth travel of the platforms 102*a*, 102*b* when the crank 122 is rotated.

Use of the fixed nuts 124*a*, 124*b* with the screw shaft 120 provides a relatively simple leadscrew for translating rotation of the crank 122 into linear motion of the platforms 102*a*, 102*b*. According to other embodiments, other translational mechanisms may be employed. For example, each platform 102*a*, 102*b* may include a fixed ball nut assembly (i.e., for a ball screw), a worm gear, or similar mechanical means for converting rotation of the crank 122 and screw shaft 120 into linear motion of the platforms 102*a*, 102*b*.

To prevent overtravel of the platforms 102*a*, 102*b*, or unthreading of the screw shaft 120 from the fixed nuts 124*a*, 124*b* the frame 130 and the platforms 102*a*, 102*b* include points of contact that function as hard stops. Further outward lateral travel of the platforms 102*a*, 102*b* beyond $W_{max}$, is prevented by sides 131 of the frame 130 contacting a center rib 135 on each platform 102*a*, 102*b*. Further inward lateral travel of the platforms 102*a*, 102*b* past $W_{min}$ is prevented by ends 133 of the guide rails 132 contacting a lip 116 on each of the platforms 102*a*, 102*b*. According to some embodiments, in the narrow configuration, the platforms 102*a*, 102*b* contact each other as a hard stop (i.e., $W_{min}$ is zero).

The crank 122 is shown disposed on the right platform 102*b* and connected to the screw shaft 120 therefrom. According to an embodiment, the crank 122 is disposed on the left platform 102*a* and connected to the screw shaft 120. According to other embodiments, the screw shaft 120 may be connected to a motor or an actuator for turning the shaft in either direction, the motor or actuator being electronically controlled by user input. According to some embodiments, the screw shaft 120 may be connected to a motor or actuator and also connected to the crank 122 such that the shaft may be turned in either direction by the motor/actuator or the crank 122 as a backup.

The adjustable foot plate 100 shown in FIGS. 1-4 may be provided as accessory equipment for retrofitting existing rowing machines. According to some embodiments, a rowing machine having the adjustable foot plate 100 attached thereto is provided. The foot plate may be removably attached to a rowing machine by one or more mounting points 134. The mounting points 134 may include screws or other fasteners. According to other embodiments, the adjustable foot place 100 is permanently attached to the rowing machine by fasteners or by welding/bonding the frame of the adjustable foot plate 100 to a frame of the rowing machine.

Figure 5A:
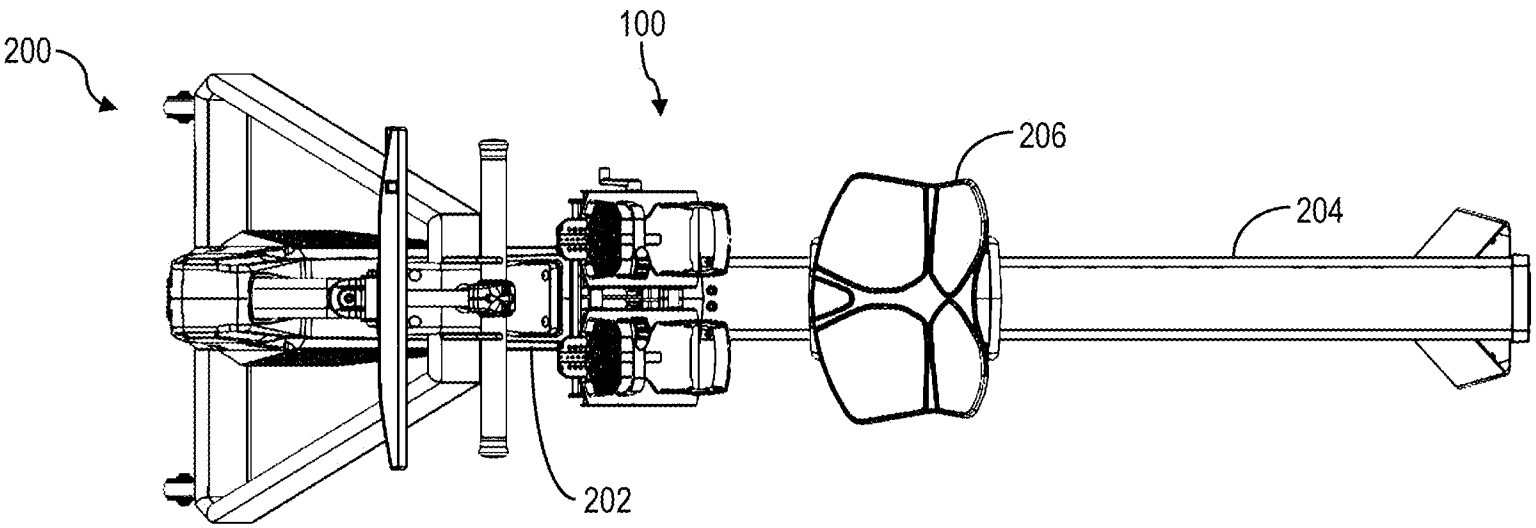
FIG. 5A is a top view of an adjustable foot plate attached to a rowing machine, according to an embodiment.
Figure 5B:
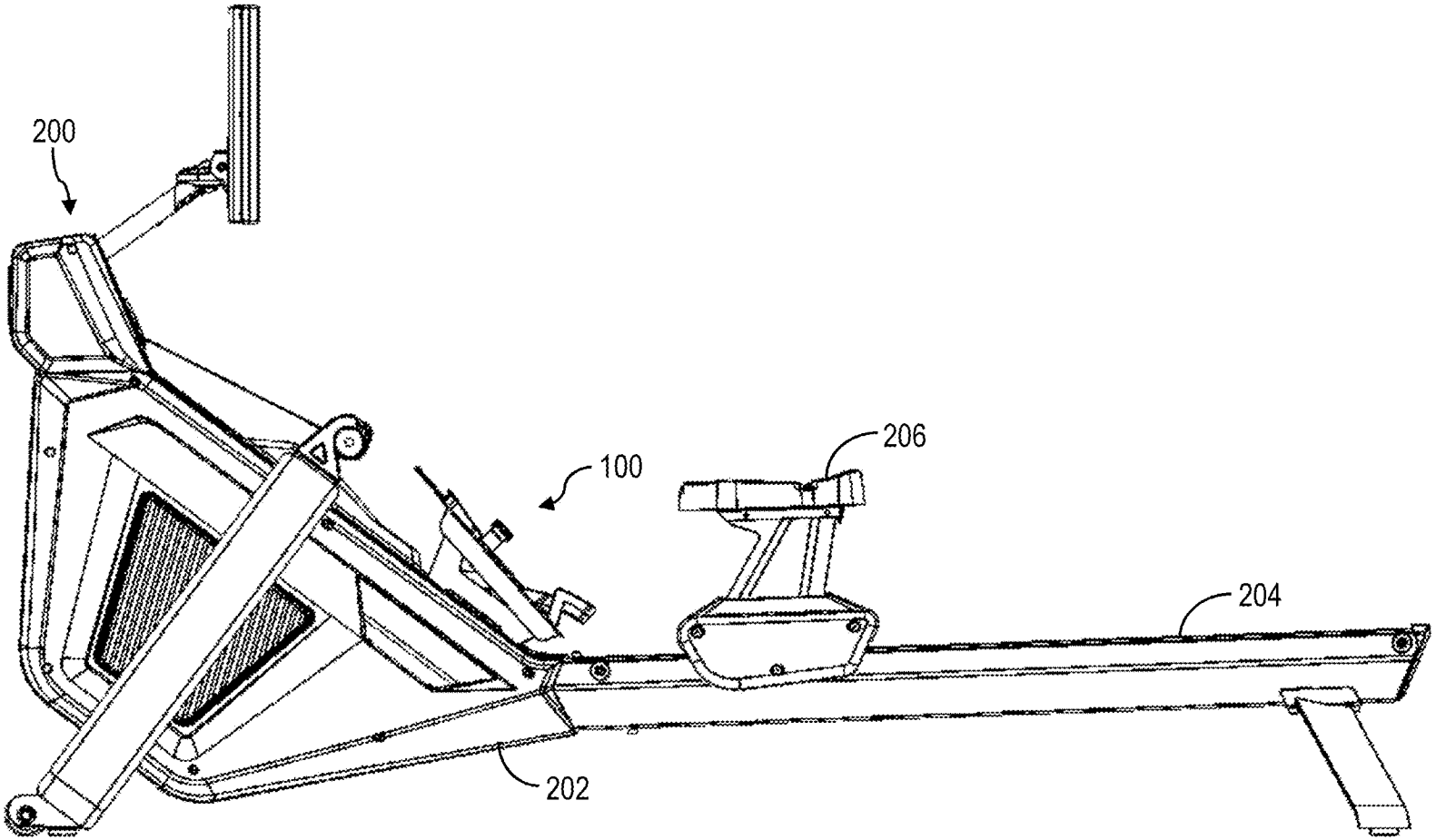
FIG. 5B is a side view of the adjustable foot plate and the rowing machine shown in FIG. 5A.

Referring to FIGS. 5A and 5B, shown therein is the adjustable foot plate 100 shown attached to a rowing machine 200, according to an embodiment. The foot plate 100 is attached to a frame 202 and straddles a seat rail 204 of the rowing machine 200. The foot plate 100 is attached to the frame 202 at a position forward of a seat 206.

A benefit of adjusting the lateral position of the platforms 102*a*, 102*b* is that it may provide for different users of varying height/size, hip width and hip flexibility, to comfortably use the rowing machine for prolonged periods of time by laterally adjusting the platforms 102*a*, 102*b*, as needed, for a comfortable rowing stroke. For example, using the rowing machine with the foot plate 100 in the wide configuration (FIGS. 1A, 2A, 3A and 4A) may be beneficial for larger/taller users having wider hips; whereas using the rowing machine with the foot plate 100 in the narrow configuration (FIGS. 1B, 2B, 3B and 4B) may be beneficial for smaller/shorter users having narrower hips. Lateral adjustment of the platforms may also provide for the user to exercise different muscle groups as part of an exercise regime.

While the above description provides examples of one or more apparatus, methods, or systems, it will be appreciated that other apparatus, methods, or systems may be within the scope of the claims as interpreted by one of skill in the art.

The invention claimed is:

1. An adjustable foot plate for a rowing machine, the adjustable foot plate comprising:
- a frame, comprising:
  - at least one mounting point for attaching the adjustable foot plate to the rowing machine; and
  - a pair of parallel guide rails;
- a left foot platform and a right foot platform mounted on the pair of parallel guide rails; and
- a linear drive mechanism for moving the left foot platform and the right foot platform laterally along the pair of parallel guide rails,
- wherein outward lateral travel of the left foot platform and the right foot platform beyond a maximum distance is prevented by respective sides of the frame contacting a center rib on each of the left foot platform and the right foot platform; and
- wherein inward lateral travel of the left foot platform and the right foot platform past a minimum distance is prevented by respective ends of the pair of parallel guide rails contacting a lip on each of the left foot platform and the right foot platform.

2. The adjustable foot plate of claim 1, wherein the linear drive mechanism comprises:
- a first-handed fixed nut on the left foot platform;
- a second-handed fixed nut on the right foot platform;
- a screw shaft, comprising:
  - a first-handed threaded segment passing through the first-handed fixed nut;
  - a second-handed threaded segment passing through the second-handed fixed nut; and
- a crank connected to the screw shaft.

3. The adjustable foot plate of claim 2, wherein turning the crank in a first direction causes the left foot platform and the right foot platform to travel laterally along the pair of parallel guide rails, to increase a distance between the left foot platform and the right foot platform.

4. The adjustable foot plate of claim 3, wherein turning the crank in a second direction, opposite to the first direction, causes the left foot platform and the right foot platform to travel laterally along the pair of parallel guide rails, to decrease a distance between the left foot platform and the right foot platform.

5. The adjustable foot plate of claim 2, further comprising a support member disposed on the frame between the left foot platform and the right foot platform at an equidistant point between the fixed nuts, the support member configured for holding the screw shaft in parallel with the pair of parallel guide rails.

6. The adjustable foot plate of claim 2, wherein each of the first-handed fixed nut and the second-handed fixed nut is one of: a nut plate, a T-nut, a leadscrew nut, a ball screw nut.

7. The adjustable foot plate of claim 1, wherein each of the left foot platform and the right foot platform further comprises:
- a strap configured for securing a user's foot to the respective foot platform;
- a locking member including locking lugs; and
- a lengthening member having a heel counter and a front end, the front end configured to pass under the strap and through the locking member,
- wherein the strap is disposed between the heel counter and the locking member.

8. The adjustable foot plate of claim 7, wherein the front end is moveable through the locking member to vary a distance between the heel counter and the strap.

9. The adjustable foot plate of claim 7, wherein the locking member fixedly holds the front end to fix a distance between the strap and the heel counter.

10. A rowing machine, comprising:
- an adjustable foot plate mounted to a frame of the rowing machine, the adjustable foot plate comprising:
  - a frame comprising a pair of parallel guide rails;
  - a left foot platform and a right foot platform mounted on the pair of parallel guide rails;
  - a linear drive mechanism for moving the left foot platform and the right foot platform laterally along the pair of parallel guide rails,
  - wherein outward lateral travel of the left foot platform and the right foot platform beyond a maximum distance is prevented by respective sides of the frame contacting a center rib on each of the left foot platform and the right foot platform; and
  - wherein inward lateral travel of the left foot platform and the right foot platform past a minimum distance is prevented by respective ends of the pair of parallel guide rails contacting a lip on each of the left foot platform and the right foot platform.

11. The rowing machine of claim 10, wherein the linear drive mechanism comprises:
- a first-handed fixed nut on the left foot platform;
- a second-handed fixed nut on the right foot platform;
- a screw shaft, comprising:
  - a first-handed threaded segment passing through the first-handed fixed nut;
  - a second-handed threaded segment passing through the second-handed fixed nut; and
- a crank connected to the screw shaft.

12. The rowing machine of claim 11, wherein turning the crank in a first direction causes the left foot platform and the right foot platform to travel laterally along the pair of parallel guide rails, to increase a distance between the left foot platform and the right foot platform.

13. The rowing machine of claim 12, wherein turning the crank in a second direction, opposite to the first direction, causes the left foot platform and the right foot platform to travel laterally along the pair of parallel guide rails, to decrease a distance between the left foot platform and the right foot platform.

14. The rowing machine of claim 10, wherein each of the left foot platform and the right foot platform comprises:

a strap configured for securing a user's foot to the respective foot platform;

a locking member including locking lugs; and a lengthening member having a heel counter and a front end, the front end configured to pass under the strap and through the locking member, wherein the strap is disposed between the heel counter and the locking member.

15. The rowing machine of claim 14, wherein the front end is moveable through the locking member to vary a distance between the heel counter and the strap.

16. The rowing machine of claim 14, wherein the locking member fixedly holds the front end to fix a distance between the strap and the heel counter.

17. The rowing machine of claim 10, wherein the adjustable foot plate straddles a seat rail of the rowing machine.

* * * * *